US010991526B1

(12) United States Patent
Lynch

(10) Patent No.: US 10,991,526 B1
(45) Date of Patent: Apr. 27, 2021

(54) FUSE CUTOUT COVER WITH VARIABLE ROOFS FOR DIFFERENT FUSE CUTOUTS

(71) Applicant: Eco Electrical Systems, Reno, NV (US)

(72) Inventor: Michael Lynch, Reno, NV (US)

(73) Assignee: Eco Electrical Systems, Reno, NV (US)

( * ) Notice: Subject to any disclaimer, the term of this patent is extended or adjusted under 35 U.S.C. 154(b) by 0 days.

(21) Appl. No.: 16/591,039

(22) Filed: Oct. 2, 2019

(51) Int. Cl.
*H01H 31/12* (2006.01)
*H01H 31/00* (2006.01)

(52) U.S. Cl.
CPC ..... *H01H 31/127* (2013.01); *H01H 31/006* (2013.01); *H01H 2223/044* (2013.01)

(58) Field of Classification Search
CPC ..... H01H 31/127; H01H 2223/044; H01H 85/185; H01H 31/006; H01H 21/165; H01H 31/122; H02B 1/06
USPC ..... 337/168, 171, 202, 403
See application file for complete search history.

(56) References Cited

U.S. PATENT DOCUMENTS 5,300,912 A * 4/1994 Tillery ..... H01H 31/127 174/179
9,916,956 B1 * 3/2018 Rauckman ..... H01H 85/25
2004/0207505 A1 * 10/2004 Borchardt ..... H01H 31/127 337/186
2008/0128163 A1 * 6/2008 Bradford ..... H01H 31/127 174/5 R
2013/0087378 A1 * 4/2013 Behnken ..... H01B 19/00 174/5 R
2015/0068798 A1 * 3/2015 Niles ..... H01B 17/00 174/5 R
2020/0083694 A1 * 3/2020 Niles ..... H02G 1/02

* cited by examiner

*Primary Examiner* — Stephen S Sul
(74) *Attorney, Agent, or Firm* — Patent Law Group; Brian D. Ogonowsky

(57) ABSTRACT

In one embodiment, a fuse cutout cover has an integral roof portion. The roof portion covers the energized top of a fuse in a first type of cutout. An attachable roof extension covers the energized top of a fuse in a larger second type of cutout, such as a Fault Tamer™ cutout. By adding the roof extension, the same cover may be used with two types of cutouts, and there is not a large gap over the fuse, preventing wildlife from entering the gap. In another embodiment, a second roof is formed over the first roof portion to accommodate different types of cutouts. Electrical insulation between wildlife and the energized cutout is also increased.

19 Claims, 10 Drawing Sheets

FUSE CUTOUT COVER WITH VARIABLE ROOFS FOR DIFFERENT FUSE CUTOUTS

FIELD OF THE INVENTION

The invention relates to a dielectric cover for a high voltage fuse cutout that protects birds and other animals from electrocution, which may also trigger an over-current condition that causes a power outage. The invention more particularly relates to a customizable cover that can cover a variety of types of fuse cutouts while ensuring protection for the wildlife and preventing the formation of a large sheltered opening that may be inviting for birds and squirrels.

BACKGROUND

FIGS. 1-3 illustrate a problem with one type of cutout cover, but all cutout covers known to the inventor have similar problems. The cutout cover of FIG. 3 is the inventor's own previous design.

FIG. 1 illustrates a conventional fuse cutout 10. A mounting bracket 12 secures a ceramic or polymer insulator 14 to a wooden utility pole or cross-arm used to support high voltage conductors, such as carrying 3-phase 12KVAC or higher. A "hot" wire 16 is attached to one phase. A metal wire connector 18 electrically connects the wire 16 to a metal top connector 20 whose end electrically contacts the top of a blowable fuse 22. The fuse 22 electrically connects to a pivot joint 24 and a bottom connector 26. The bottom connector 26 is connected to another wire (not shown) which may lead to a transformer or any other electrical device or conductor. Opening or blowing of the fuse 22 disconnects the top connector 20 from the bottom connector 26.

A metal hook assembly 28 is fixed to the top connector 20 and is used to temporarily support a loadbreak tool for opening the fuse 22 (described with respect to FIG. 2). The bent hook assembly 28 is better shown in later figures. A metal pull ring 30 is physically and electrically connected to the upper end of the fuse 22 for pulling down the fuse 22 and pushing it back in place.

FIG. 2 is a simplified illustration of a portion of a conventional loadbreak tool 34, such as the Loadbuster™ by S&C Electric Company, that is used by linemen to open the fuse 22 while the wire 16 is energized. A description of the well-known Loadbuster™ is found at the web address http://www.sandc.com/en/products--services/products/load-buster-tool/ and is incorporated herein by reference. A long dielectric pole 35 is affixed to the bottom portion of the loadbreak tool 34 for manipulating the loadbreak tool 34 by the lineman. The diagram of the loadbreak tool 34 is intended to illustrate any loadbreak tool or hotstick used by a lineman that allows the lineman to open and close the fuse 22 while the wire 16 is energized. The loadbreak tool 34 is formed of a dielectric material with two metal hooks that engage the cutout 10, as described below, to allow the lineman to open and close the fuse 22 at a distance to avoid arcing.

The loadbreak tool 34 is positioned by a lineman, while the wire 16 is energized, so that an opening in a metal upper hook 36 of the loadbreak tool 34 is physically and electrically engaged with the metal hook assembly 28 of the cutout 10. Another metal hook 37 at the end of the pole 35 is physically and electrically engaged with the metal pull ring 30, electrically connected to the top of the fuse 22. The metal hook 37 is electrically connected to a loadbreak mechanism internal to the loadbreak tool 34. When the lineman pulls down on the pole 35, the slidable portion 38 is also pulled down. When the pole 35 and slidable portion 38 are pulled down by the lineman, the fuse 22 is pulled away from the top connector 20, and the loadbreak tool 34 creates a parallel circuit (internal to the loadbreak tool 34) that prevents external arcing while the fuse 22 is being pulled down. Once the fuse 22 is pulled down a certain distance, a spring in the loadbreak tool 34 rapidly separates contacts within the loadbreak tool 34 to quelch arcing. The loadbreak tool 34 is then removed, and there is an open circuit between the wire 16 and the bottom connector 26.

In a simpler version, the loadbreak tool is simply a stick with a hook that engages the pull ring 30 to allow the linemen to open the fuse 22 when the wire 16 is energized.

FIG. 3 illustrates a representative cutout cover 50, designed by the Applicant, used to show a problem that exists with most or all cutout covers. The cover 50 is partially transparent to show the cutout 10.

The cover 50 is a one-piece molded polymer.

A first portion 52 of the cover 50 includes a vertical slot 54 through which the energized wire 16 is inserted when installing the cover 50 over the cutout 10. The first portion 52 also covers the top of the insulator 14 (above the top skirt) to prevent wildlife from contacting the wire connector 18.

A second portion 58 of the cover 50 includes a flat roof 60, which covers the energized top connector 20 and portions of the hook assembly 28 and pull ring 30. The roof 60 is slightly wider than the top connector 20, hook assembly 28, and pull ring 30 to prevent birds alighting on the energized top connector 20, hook assembly 28, and pull ring 30. In the embodiment shown, the roof 60 rests on an energized connector, while the back portion of the cover 50 rests on the insulator 14.

The sidewalls 62 of the second portion 58 flare out and terminate before the end of the cover 50 in order to allow the loadbreak tool 34 (FIG. 2) to enter from the side. The roof 60 is flat (rather than arched) so as not to restrict lateral movement of the loadbreak tool. No sidewall is laterally located next to the hook assembly 28 and pull ring 30 to allow maximum access by the loadbreak tool. The sidewalls 62 extend down to approximately the level of the hook assembly 28.

The cover 50 has a middle expanded portion 64 to accommodate the wire connector 18 and the top portion of the insulator 14.

The cover 50 has through-holes 66, 67, and 68. In an example of one type of insulator 14, identical securing pins (not shown) are inserted, using a hotstick, through the holes 66 and 68 and under the top connector 20 to keep the cover 50 in place in high winds. For a wider insulator 14, the pins would be inserted through the holes 67 and 68. The pin through hole 67 goes under the wire connector 18. A suitable pin is described in Applicant's U.S. Pat. No. 8,963,011, incorporated herein by reference. The holes 66, 67, and 68 may also be grabbed by a hot stick to position the cover 50.

Once the cover 50 is installed, a bird on the cross-arm of the utility pole cannot contact the energized metal of the cutout 10 since the opening in the cover 50 is facing away from the cross-arm. Since there is very little open space in the cover 50, wildlife cannot nest in the opening and squirrels cannot store nuts in the opening.

FIG. 4 illustrates a different type of fuse cutout 70 called a Fault Tamer™, manufactured by S&C Electric Company. The cutout 70 also represents other similar types of cutouts that are much larger than the conventional fuse cutout 10 of FIG. 1. A top energized wire (not shown) electrically contacts the top of the fuse, and a bottom wire (not shown) is connected to the bottom connector 72. When the fuse is blown, the top of the cutout 70 releases from the top connector and drops down around the pivot joint 74 to provide a visual indication that the fuse has blown.

A conventional fuse cutout (FIG. 1) has a wire that melts with an over-current, and this molten metal may cause a brush fire in dry conditions if it drops on the ground. The Fault Tamer™ encases the fuse in sand so molten metal is not ejected. The Fault Tamer™ also includes a fault current limiter that controllably drops current to zero. Hence, the Fault Tamer™ is larger than a conventional cutout. The Fault Tamer™ has become increasingly popular in areas where fires are an issue.

As seen in FIG. 4, the Fault Tamer™ cutout 70 has an energized metal top portion 76 that extends laterally beyond and vertically above the roof 60 of the cover 50. Therefore, the cover 50 provides little protection for wildlife that may alight on the top of the cutout 70 or the cover 50. The cutout 70 has the conventional pull ring 80 and hook assembly 82 for opening and closing the cutout 70. Typical high voltages used with the cutout 70 are 12 KV to 25 KV.

Since the cutouts 10 and 70 are interchangeable, it would be desirable to provide a dielectric cutout cover that can be customized for either type of cutout while ensuring protection for the wildlife and preventing the formation of a large sheltered opening that may be inviting for birds and squirrels.

SUMMARY

In one embodiment of the invention, a fuse cutout cover is provided that has a roof portion that is raised so that the roof is vertically higher than either a conventional fuse cutout or a Fault Tamer™ cutout.

A Fault Tamer™ fuse extends out laterally from the insulator further than the conventional cutout fuse extends. The cover's roof is adequate to cover the top of the conventional cutout fuse. If a Fault Tamer™ cutout is used, a dielectric roof extension is affixed to the roof to laterally extend the roof to cover the Fault Tamer™ fuse.

The roof extension may be affixed using plastic bolts or affixed in other ways. The extension may even be a molded portion of the cover. The roof extension may be added using tools (e.g., an Allen wrench) or require no tools (wingnuts).

To accommodate even more types of cutout sizes, there are three roofs provided in a single cutout cover. The lower roof only accommodates the conventional cutout. An intermediate roof is above the lower roof and has holes for receiving bolts to attach a roof extension. For the largest cutouts, the extension is attached to the upper roof.

Providing an optimal roof height above the top of the cutout is important since the roof must provide enough gap to achieve the desired insulating properties, but the gap should not be large enough so that birds and squirrels can reside in the sheltered gap. Further, the gap may provide added vertical clearance to more easily allow a lineman to position the loadbreak took without touching the roof.

To provide good vertical clearance between the top of an energized cutout component and the cover's roof, a spacer is molded into the cover that causes the roof of the cover over the cutout's hook assembly to be spaced further above the hook assembly. This gives the lineman more vertical space above the cutout to engage the loadbreak tool with the hook assembly and pull ring of the cutout. The extra clearance also provides more electrical insulation between a bird touching the roof and the energized component of the cutout.

In one embodiment, the spacer is a vertical wall within the cover whose bottom edge rests on the energized top connector of the cutout. Without the wall, the roof of the cover would rest directly on the top connector. The wall also blocks birds and other animals from entering the enlarged opening around the hook assembly, so there is synergy.

The wall also creates an additional air gap between the energized top connector and the outer surface of the cover, so the insulating properties of the cover are improved, creating further synergy.

The cover to be improved by the variable roof height, roof extensions, and wall spacer may be that previously described or any other existing cover.

BRIEF DESCRIPTION OF THE DRAWINGS

FIG. 10 shows two roof extensions used simultaneously, only one of them would actually be used.

Elements in the various figures that are the same or equivalent are labelled with the same numeral.

DETAILED DESCRIPTION

FIGS. 5-8 illustrate one embodiment of the invention used with a Fault Tamer™ cutout 70, and the inventive feature can be applied to any type of cutout cover.

Figure 3:
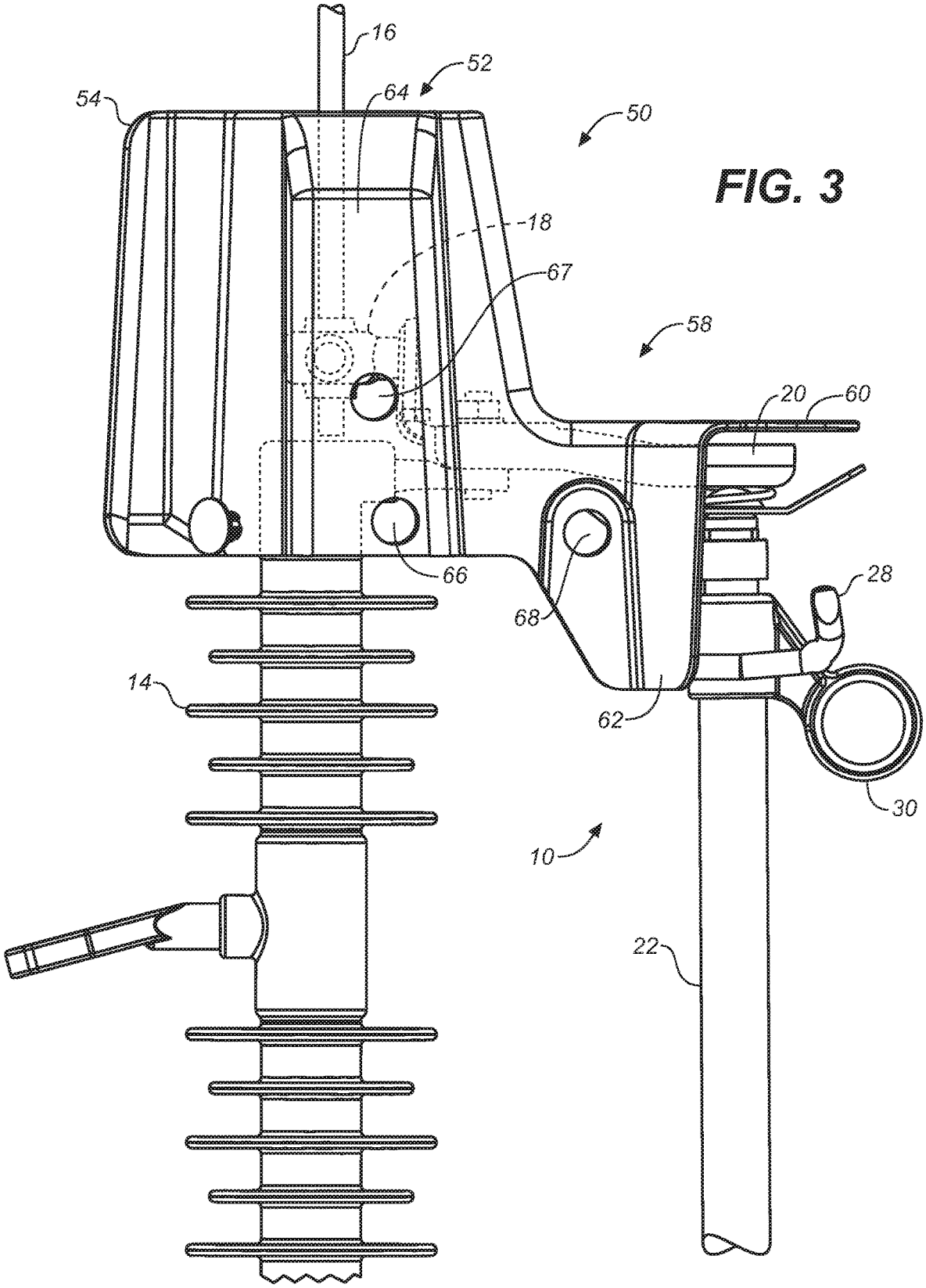
FIG. 3 is a partially transparent side view of a cover, without the inventive feature, installed over the cutout of FIG. 1, where the roof of the cover rests on the energized top connector of the cutout.

The cutout cover 86 of FIGS. 5-8 may be similar to that shown in FIG. 3 except for the addition of an inner spacer wall 88 (FIG. 8) molded in the cover 86 to raise the roof 90, the cover 86 being taller to accommodate the wall 88, and the raised roof 90 having a customizable roof extension 92 affixed to it.

The cover 86 has a rear vertical slot 94 for receiving an energized wire 16 (FIG. 1) connected to the Fault Tamer™ cutout 70. The wire 16 extends through a top opening 96 after installation.

Figure 1:
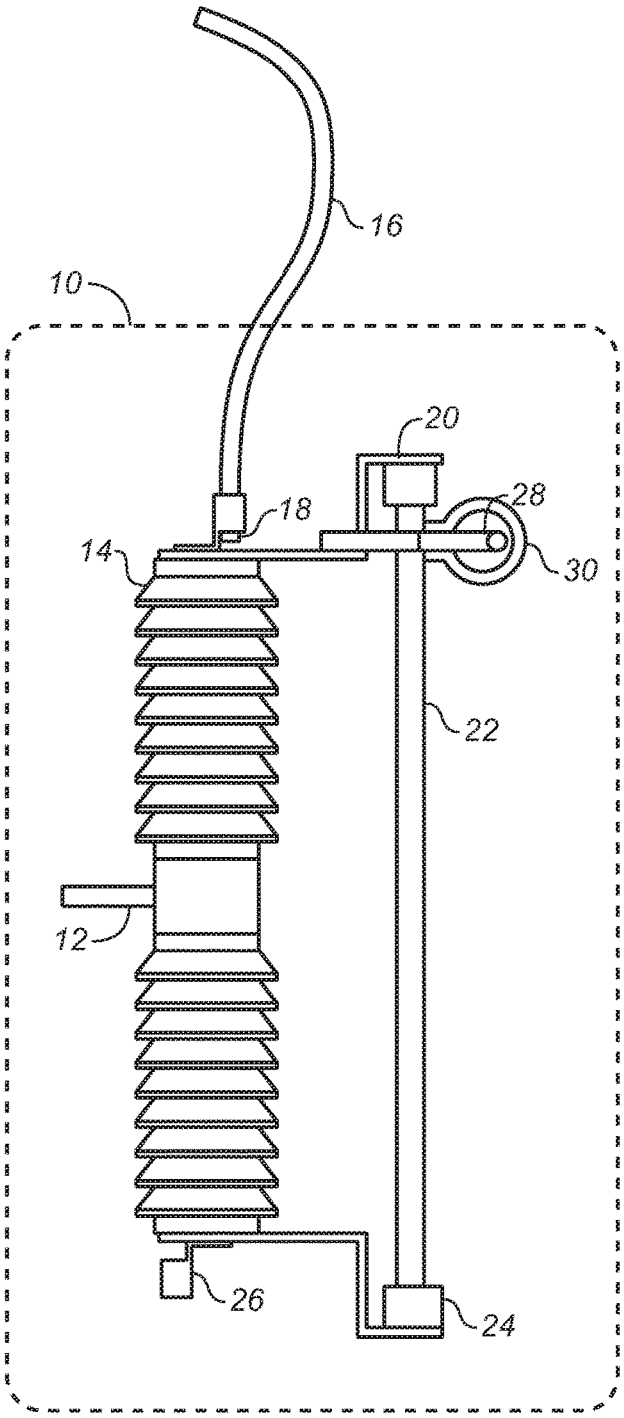
FIG. 1 (PRIOR ART)
FIG. 1 is a side view of a conventional fuse cutout.
Figure 2:
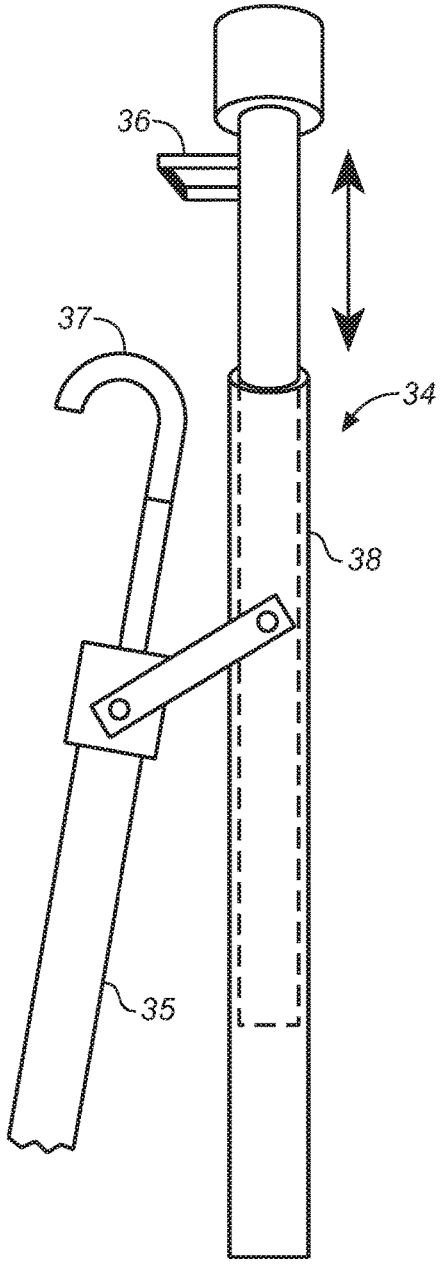
FIG. 2 (PRIOR ART)
FIG. 2 illustrates a conventional loadbreak tool for operating a conventional cutout.

The back portion of the cover 86 covers the insulator 14 and the cutout's wire connector (similar to the connector 18 in FIG. 1). The middle of the back portion has a widened section 98 to accommodate the top of the insulator 14. The front portion has a molded roof 90 that covers the cutout's energized top connector 100 and a portion of the hook assembly 82. The front portion includes a flared out opening 102 to allow the loadbreak tool 34 (FIG. 2) to access the hook assembly 82 and pull-ring 80 through a wide range of angles. The roof 90 is shown flat, but may be arched to make it more difficult for a bird to perch on it.

The roof 90 has holes for attachment of a polymer roof extension 92 that covers the top portion 76 of the fuse area.

Through-holes 106, 107, and 108 receive pins 110 (FIG. 6) that extend under the top connector 100 of the cutout 70 to keep the cover 86 in place in high winds.

The holes 112 and 114 (FIG. 6) in the roof 90 can be grabbed with a hot stick to position the cover 86 over the cutout 70.

The same cover 86, but without the roof extension 92, may be used with the conventional cutout 10 of FIG. 1. With such a smaller cutout, the roof extension 92 is not needed and would create a large sheltered gap for birds and squirrels to enter.

Figure 6:
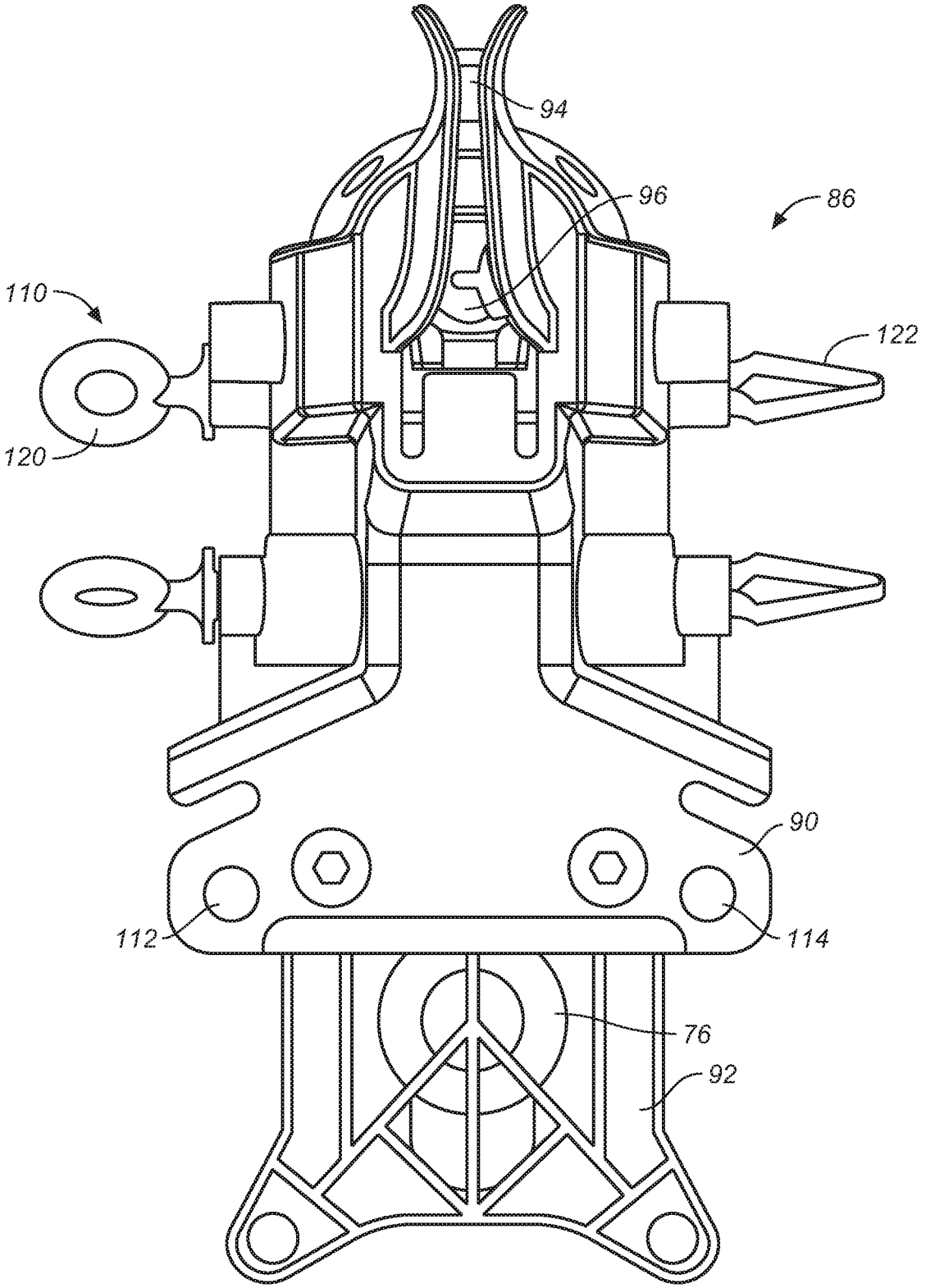
FIG. 6 is a partially transparent top down view of the structure of FIG. 5.

FIG. 6 is a top down view of the installed cover 86 showing how the roof extension 92 is vertically overlying the top portion 76 of the fuse area.

Figure 7:
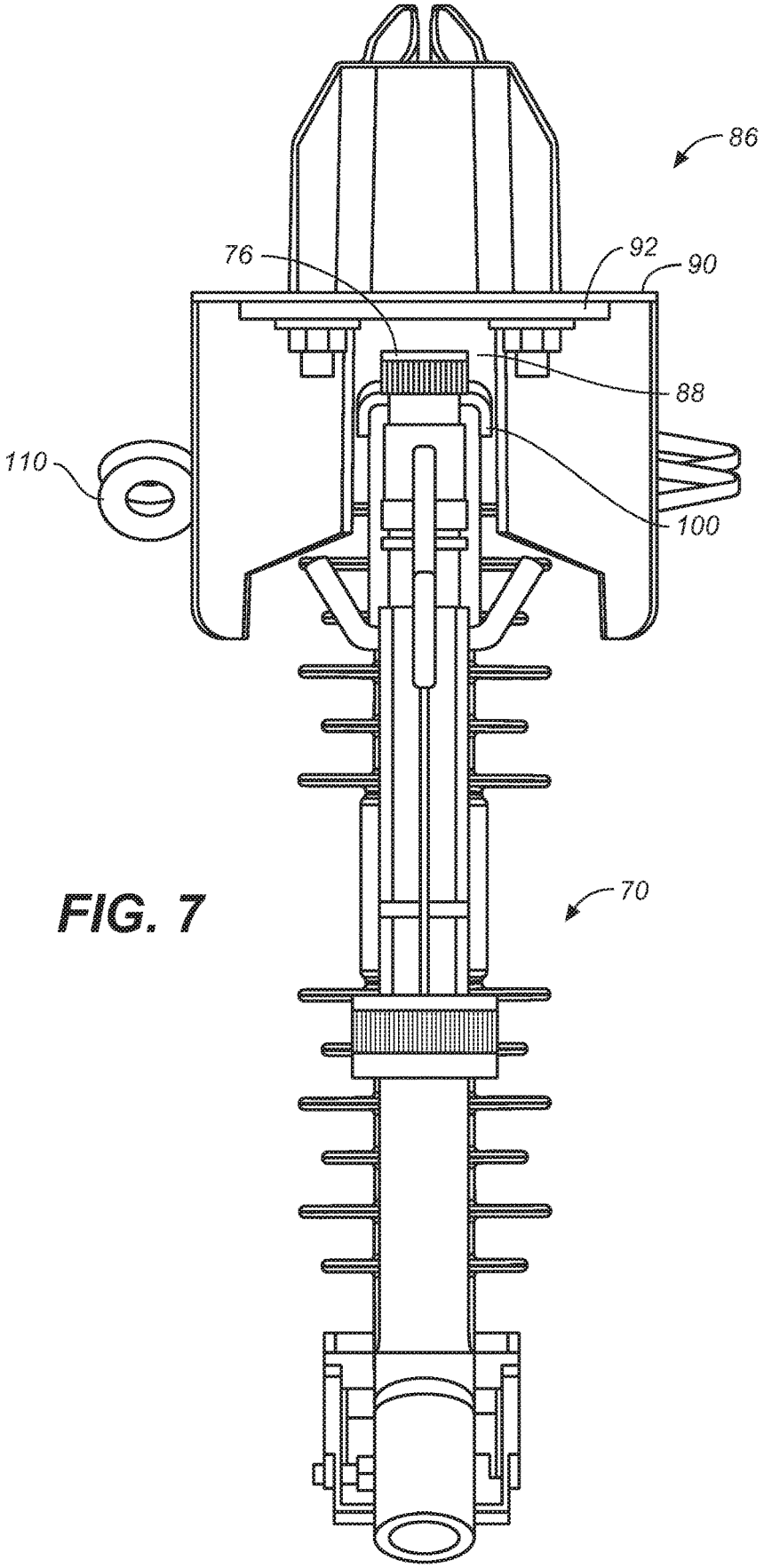
FIG. 7 is a front view of the structure of FIG. 5, showing a spacer wall that rests on an energized connector of the cutout.
Figure 8:
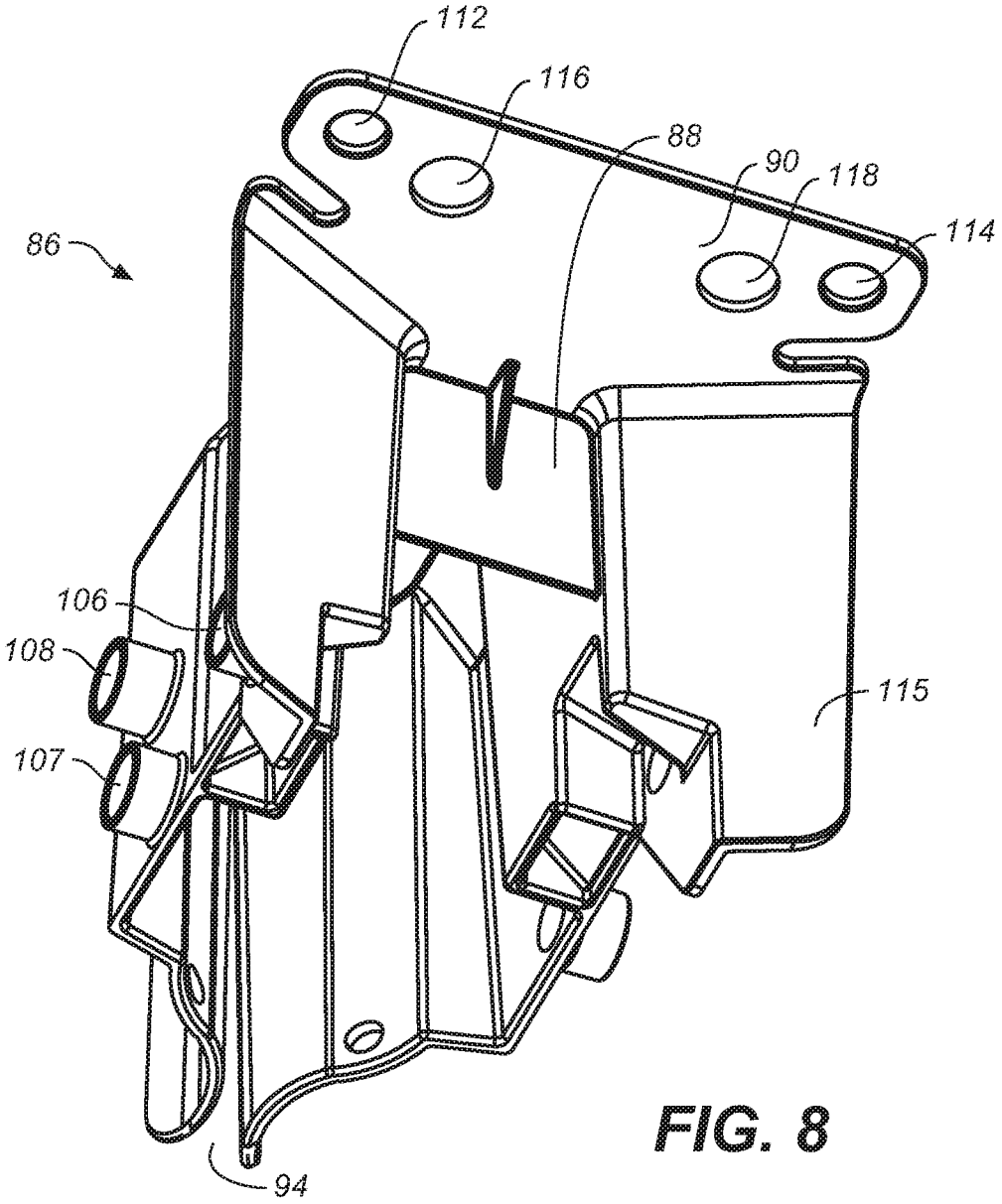
FIG. 8 is a perspective view of the cover of FIGS. 5-7 showing the spacer wall and holes in the roof for attaching an optional roof extension.

FIGS. 7 and 8 show the molded spacer wall 88 whose bottom edge rests on the energized top connector 100 of the cutout 86 to support the cover 86 and space the roof 90 well above the energized top portion 76 of the fuse. The spacer wall 88 also blocks access to the enlarged space over the top connector 100 so that birds cannot build a nest in the enlarged space, or squirrels cannot store nuts in the enlarged space. The spacer wall 88 should be located slightly in back of the sidewalls 115 (FIG. 8) flaring out near the opening.

Figure 4:
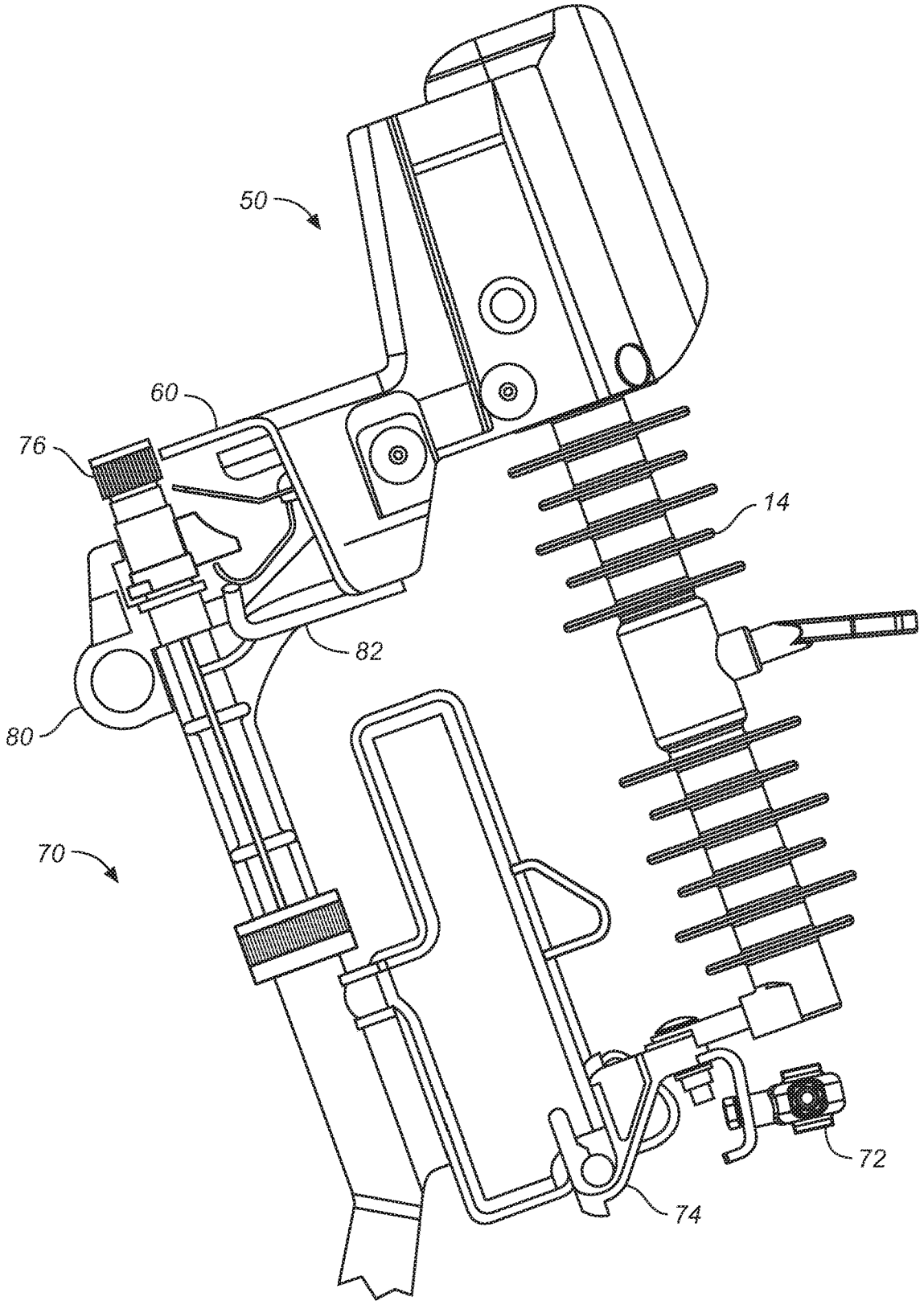
FIG. 4 illustrates a problem with the cover of FIG. 3 being used with a larger fuse cutout, such as the Fault Tamer™ cutout.

In one embodiment, the roof 90 is about 2-3 inches higher than the roof 60 (FIG. 4) of the previous cover 50, so the roof 90 is well above the energized top connector 100 (for improved electrical insulation). This enables the use of the cover 86 with either the Fault Tamer™ cutout or the conventional cutout. With the Fault Tamer™ cutout, the roof extension 92 is also used. The higher roof 90 also gives more vertical clearance for the loadbreak tool.

Figure 5:
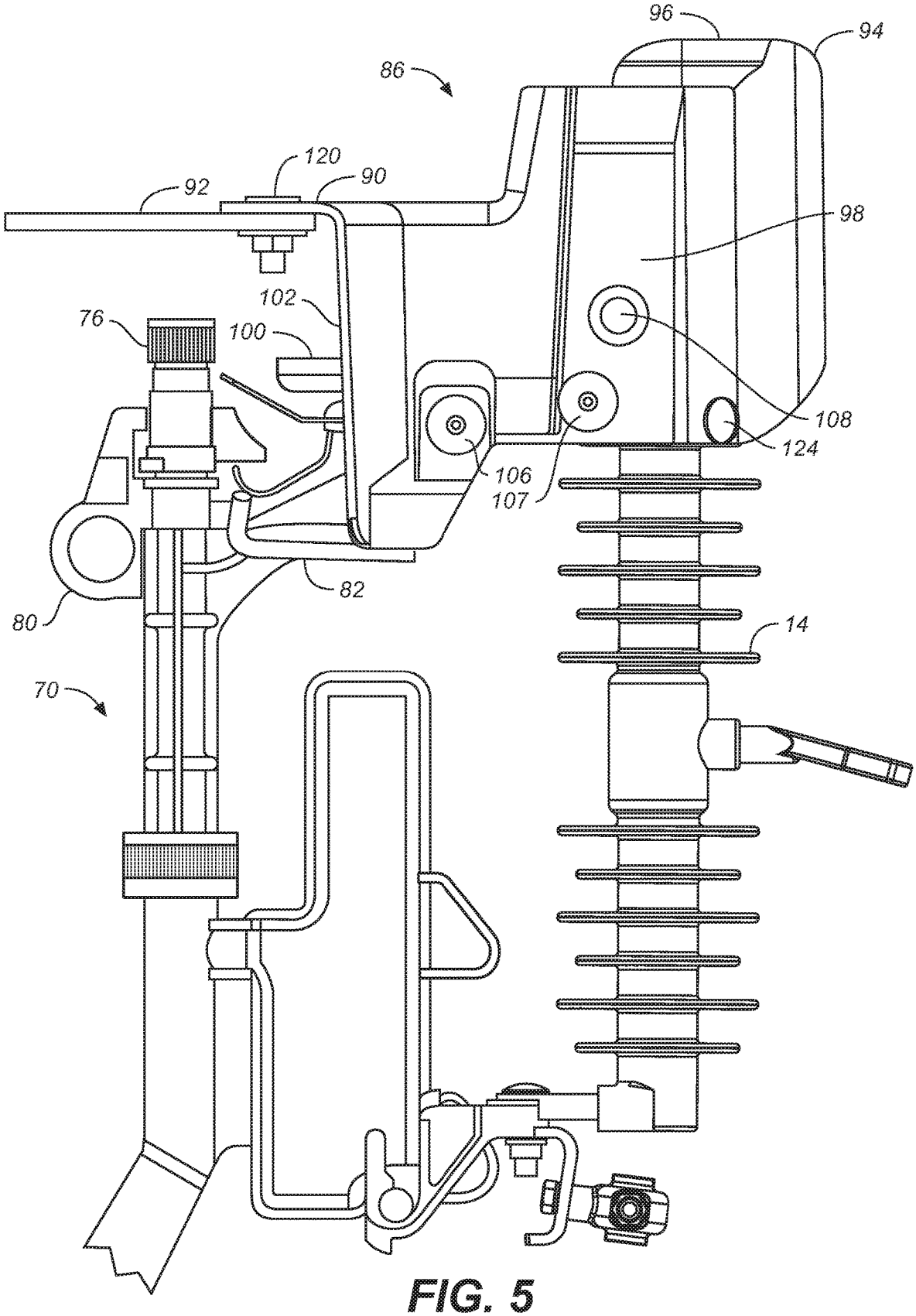
FIG. 5 is a side view of one embodiment of the new cutout cover design, showing a higher roof and a customizable roof extension. The roof extension is used with a Fault Tamer™ cutout (shown) but not used with a conventional cutout.

FIG. 8 does not show the roof extension 92 (FIG. 5) and shows holes 116 and 118 in the roof 90 for attachment of the roof extension 92 using plastic bolts 120 (FIG. 5). The bolts 120 may be installed using tools (e.g., an Allen wrench) or no tools (e.g., using wingnuts).

The pin 110 (FIG. 6) has a ring 120 that engages a hook on a hotstick. At the other end of the pin 110 is a resilient portion 122 with a narrow tip that expands outward at about a 15 degree angle. The resilient portion 122 allows the pin 110 to be inserted easily through the holes by the hotstick, but the top of the resilient portion 122 has a 45 degree angle, which makes it much more difficult to remove the pin 110. The pin 110 extends below the top connector 100 so the cover 86 does not blow off in high winds. More detail regarding the pin 110 is found in the inventor's U.S. Pat. No. 8,963,011, incorporated herein by reference. The pin 110 need not go through both through-holes, but added security is achieved by going through both holes.

The areas with the through-holes 106-108 are stepped out from the remainder of the cover 86 to compensate for the reduced insulating properties as a result of the hole. Modeling of the design shows that the stepped out distance offsets the effect of the hole so the insulating properties of the cover 86 are fairly consistent over the cover 86.

In a preferred embodiment, the cover 86 is made only slightly wider than the cutout 70 so as to not take up excess space. This allows the cutout 70 and cover 86 to be sold in the same box that is typically used just for cutouts 70. The cover 86 is narrower than the top skirt of the insulator 14 so as to not surround the top skirt. This allows the back of the cover 86 to be supported by the top skirt of the insulator 14 and the front of the cover 86 to be supported by the bottom edge of the spacer wall 88 resting on the top connector 100. The cover 86 is designed to be approximately horizontal in this configuration if the cutout is vertical. As shown in FIG. 5, an optional plastic tab 124 extends through the cover 86 and enters a narrow portion of the insulator 14 to provide extra protection against twisting in high winds.

As seen, the cover 86 with the raised roof 90 is customizable for use with multiple sizes and types of cutouts by affixing the roof extension 92 by the lineman or the manufacturer. The raised roof with the extension 92 provides added electrical insulation between a bird and the energized components.

Figure 9:
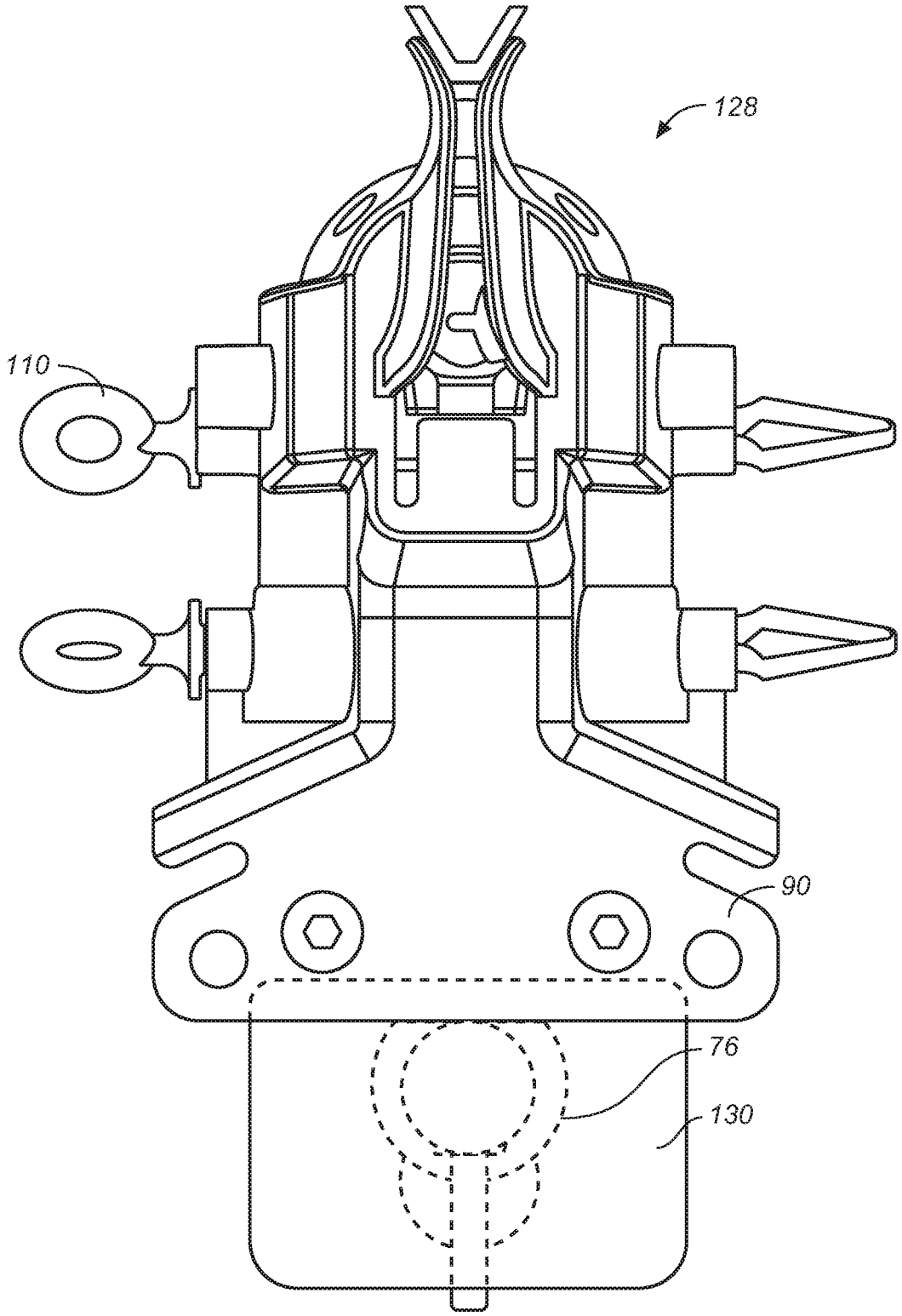
FIG. 9 is a top down view of a cover installed over a Fault Tamer™ cutout, where the roof extension is a molded portion, or the cover or is attached using other than plastic bolts.

FIG. 9 shows an embodiment of a cutout cover 128 where the roof extension 130 is permanently attached to the roof 90 by an adhesive or by being a molded portion of the cutout. The user can specify to the manufacturer whether the covers are to be customized by the lineman or by the manufacturer.

Figure 10:
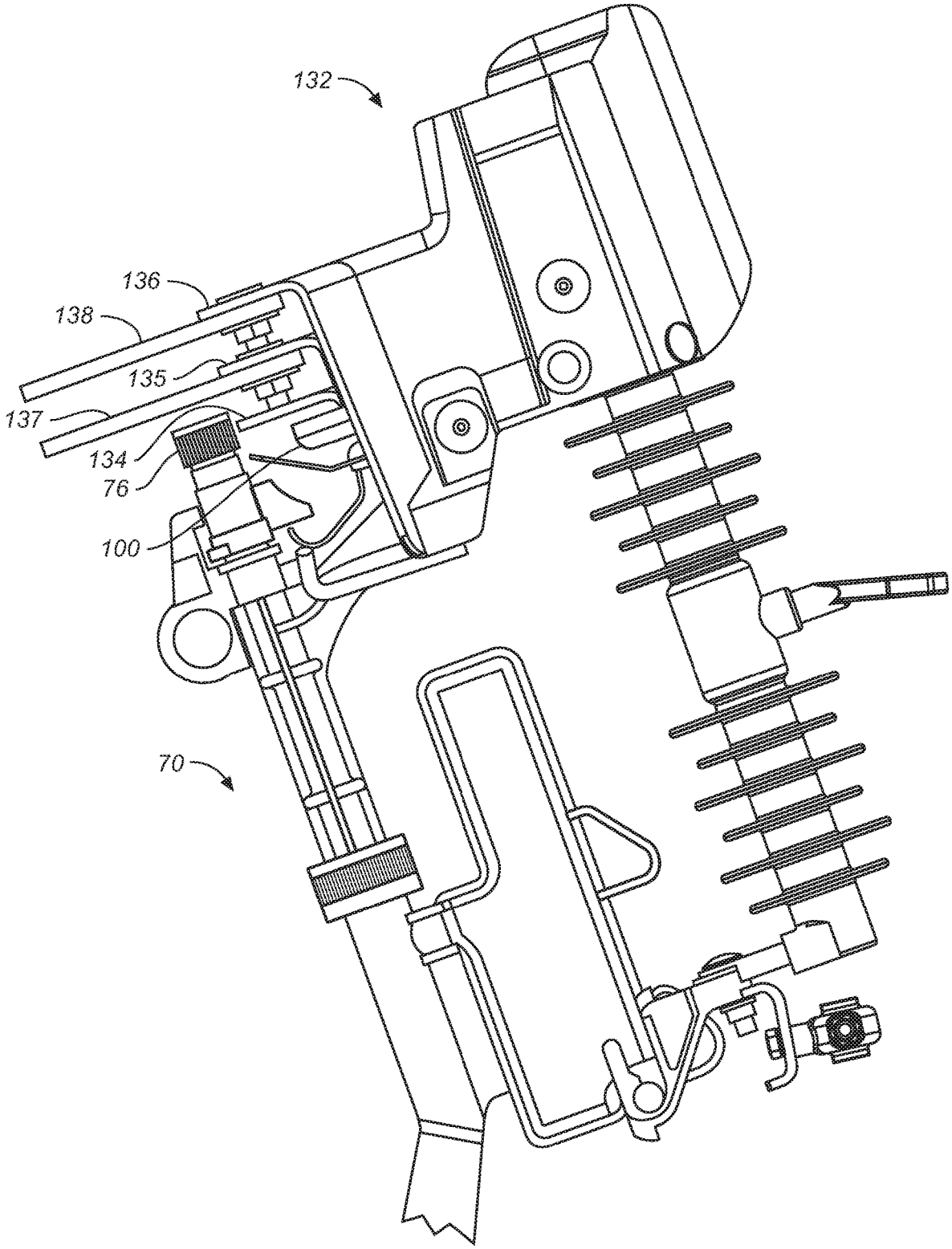
FIG. 10 illustrates how a single cover may be provided with three molded roofs, where the user or manufacturer can customize the cover for different types of fuse cutouts by attaching a roof extension to either the intermediate roof or the upper roof. Although

FIG. 10 illustrates another embodiment of a cutout cover 132 where three integral roofs 134, 135, and 136 are provided. If the cover 132 is to be used with a conventional cutout (e.g., cutout 10 in FIG. 1), the lower roof 134 will sufficiently cover the cutout, but there will be little vertical clearance between the energized top connector 100 and the lower roof 134. No roof extension is needed with a conventional cutout. The roofs 135 and 136 above the lower roof 134 provide added electrical insulation between a bird, perching on the top roof 136, and the energized components.

If the cover 132 is to be used with a Fault Tamer™ cutout or other large cutout, a roof extension 137 or 138 may be attached to the intermediate roof 135 or the upper roof 136 to cover the energized top portion 76 of the cutout while providing optimal spacing for electrical insulation and prevention of a large sheltered gap that would be inviting to birds and squirrels. Attaching the roof extension 138 to the upper roof 136 also gives the lineman more vertical clearance for the loadbreak tool.

In a variation of FIG. 10, the intermediate roof 135 is formed to be extended beyond the lower roof 134 so there is no roof extension needed. The upper roof 136 is then deleted.

Figure 11:
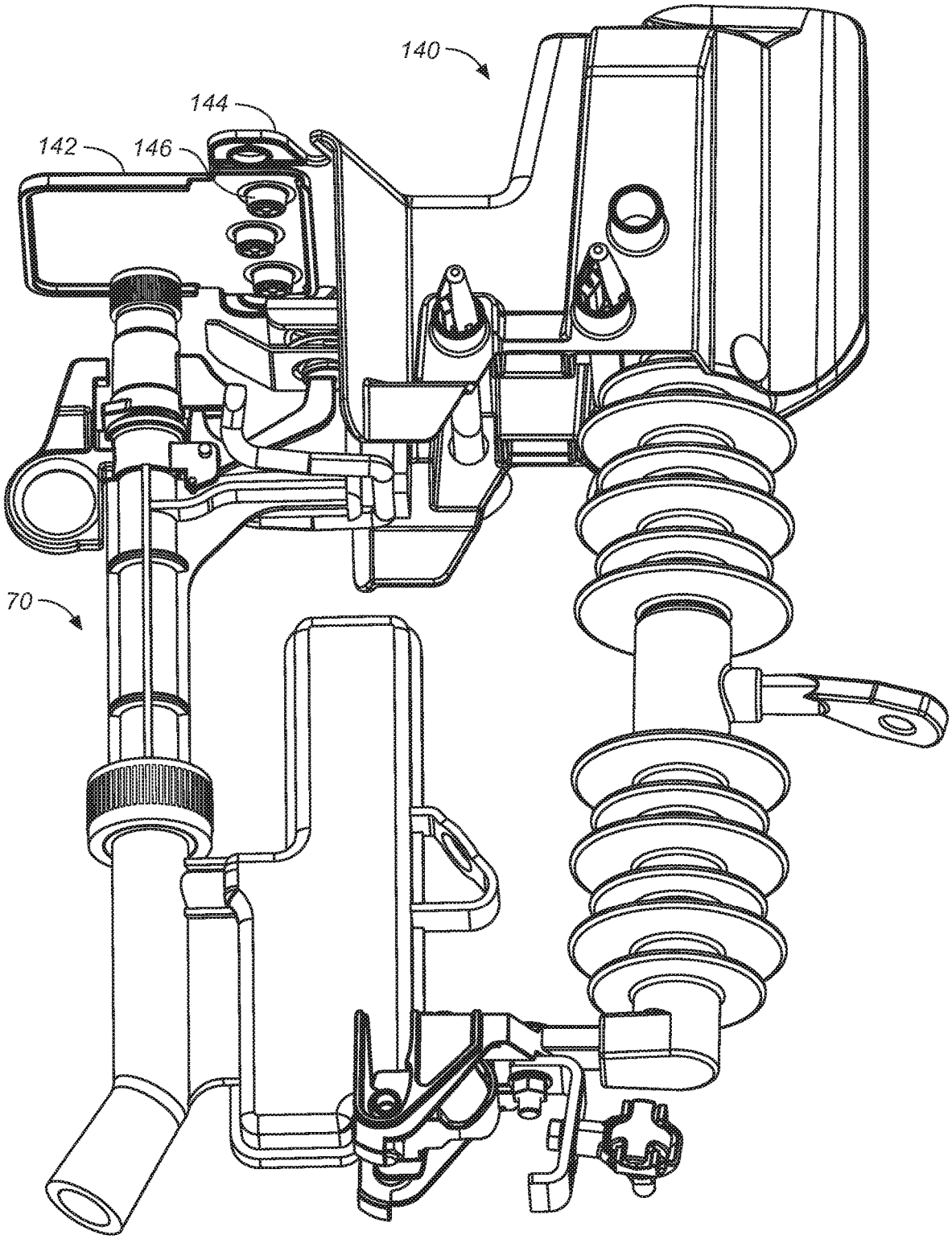
FIG. 11 illustrates how the roof extension of FIG. 5 may be attached using snaps.

FIG. 11 illustrates how the roof extension of FIG. 5 may be attached using plastic snaps. In FIG. 11, the cover 140 is identical to the cover of FIG. 5 except for the method of attachment of the roof extension 142 to the roof 144 of the cover 140. Instead of plastic bolts, plastic snaps 146 are used. The roof extension 142 has the female portion of the snap molded into it. The male portion of the snap can be either molded into the roof 144, or separate male pieces may be inserted through holes in the roof 144 which snap into the female portion of the snaps 146. The male portion of the snap has a widened end that is pushed into a resilient opening in the female portion, like a conventional snap.

In another embodiment, both the roof 144 and the roof extension 142 have holes, and separate snap pieces are inserted through the holes.

In another embodiment, any other type of attachment means may be used, such as the roof having molded resilient pieces that just snap into holes formed in the roof extension.

Other embodiments are envisioned.

Having described the invention in detail, those skilled in the art will appreciate that, given the present disclosure, modifications may be made to the invention without departing from the spirit of the inventive concept described herein. Therefore, it is not intended that the scope of the invention be limited to the specific embodiments illustrated and described.

What is claimed is:

1. A fuse cutout dielectric cover for a fuse cutout, the fuse cutout dielectric cover comprising:

a first portion configured for at least covering a top of a first insulator in a first type of fuse cutout, the first type of fuse cutout further comprising a first connector that provides electricity to a top end of a first fuse, a first metal hook assembly electrically contacting the first connector, and a first metal pull ring electrically connected to the first fuse;

a second portion extending from the first portion, the second portion having a roof portion configured for covering at least a portion of the first connector; and an attachable roof extension for extending the roof portion to cover the top end of the first fuse.

2. The fuse cutout dielectric cover of claim 1 wherein the fuse cutout dielectric cover is configured so that the roof portion covers a top end of a second fuse for a second type of fuse cutout but does not cover the top end of the first fuse for the first type of fuse cutout, wherein the second type of fuse cutout comprises a second insulator, a second connector that provides electricity to the top end of the second fuse, a second metal hook assembly electrically contacting the second connector, and a second metal pull ring electrically connected to the second fuse.

3. The fuse cutout dielectric cover of claim 1 wherein the first portion and the second portion form a single molded piece.

4. The fuse cutout dielectric cover of claim 1 wherein the attachable roof extension is attached using bolts.

5. The fuse cutout dielectric cover of claim 1 wherein the attachable roof extension is attached using one or more resilient elements.

6. The fuse cutout dielectric cover of claim 5 wherein the one or more resilient elements comprise snaps.

7. The fuse cutout dielectric cover of claim 1 wherein the roof portion has holes for attachment of the attachable roof extension.

8. The fuse cutout dielectric cover of claim 1 wherein the roof portion is a first roof portion, the fuse cutout dielectric cover further comprising a second roof portion underlying the first roof portion.

9. The fuse cutout dielectric cover of claim 8 further comprising a third roof portion underlying the second roof portion, wherein the attachable roof extension is configured to be attached to either the first roof portion or the second roof portion.

10. The fuse cutout dielectric cover of claim 1 further comprising:

a spacer wall inside the fuse cutout dielectric cover within the second portion, the spacer wall having a bottom edge that is configured to contact a top surface of the first connector to support the cover over the first type of fuse cutout and space the roof portion away from a top of the first connector.

11. The fuse cutout dielectric cover of claim 1 wherein the attachable roof extension is attached to the roof portion.

12. The fuse cutout dielectric cover of claim 1 further comprising pins configured for being inserted through holes in the fuse cutout dielectric cover for preventing the fuse cutout dielectric cover from being blown off the first type of fuse cutout.

13. The fuse cutout dielectric cover of claim 1 wherein the roof portion is substantially flat.

14. The fuse cutout dielectric cover of claim 1 wherein the roof portion covers at least a portion of the first metal hook assembly but not the first metal pull ring.

15. The fuse cutout dielectric cover of claim 1 wherein the fuse cutout dielectric cover is configured such that the first metal hook assembly and the first metal pull ring are laterally exposed, when the fuse cutout dielectric cover is installed over the first type of fuse cutout, to allow a loadbreak tool to engage the first metal hook assembly and the first metal pull ring at a wide range of angles.

16. The fuse cutout dielectric cover of claim 1 wherein the fuse cutout dielectric cover is installed over the first type of fuse cutout.

17. The fuse cutout dielectric cover of claim 1 wherein the first insulator has a top skirt, and wherein the fuse cutout dielectric cover is narrower than the top skirt so as to not surround the top skirt.

18. The fuse cutout dielectric cover of claim 1 wherein the fuse cutout dielectric cover is installed over the first type of fuse cutout, the fuse cutout dielectric cover further comprising one or more pins that extend into holes in the fuse cutout dielectric cover and below the first connector to secure the fuse cutout dielectric cover in position.

19. A fuse cutout dielectric cover for a fuse cutout, the fuse cutout dielectric cover comprising:

a first portion configured for at least covering a top of a first insulator in a first type of fuse cutout, the first type of fuse cutout further comprising a first connector that provides electricity to a top end of a first fuse, a first metal hook assembly electrically contacting the first connector, and a first metal pull ring electrically connected to the first fuse;

a second portion extending from the first portion, the second portion having a first roof portion for covering at least a portion of the first connector and for covering a top end of the first fuse in the first type of fuse cutout;

the second portion also having a second roof portion, the second roof portion overlying the first roof portion and extending beyond the first roof portion for covering a top end of a second fuse in a second type of fuse cutout, wherein the second type of fuse cutout comprises a second insulator, a second connector that provides electricity to the top end of the second fuse, a second metal hook assembly electrically contacting the second connector, and a second metal pull ring electrically connected to the second fuse; and wherein the second roof portion includes an attachable roof extension that covers the top end of the second fuse.

* * * * *